United States Patent [19]

Yasuoka et al.

[11] Patent Number: 4,646,699

[45] Date of Patent: Mar. 3, 1987

[54] METHOD FOR CONTROLLING AIR/FUEL RATIO OF FUEL SUPPLY FOR AN INTERNAL COMBUSTION ENGINE

[75] Inventors: Akimasa Yasuoka; Takeo Kiuchi, both of Tokyo, Japan

[73] Assignee: Honda Giken Kogyo Kabushiki Kaisha, Tokyo, Japan

[21] Appl. No.: 736,581

[22] Filed: May 21, 1985

[30] Foreign Application Priority Data

May 23, 1984 [JP] Japan ..... 59-104316

[51] Int. Cl.[4] ..... F02M 51/00

[52] U.S. Cl. ..... 123/489

[58] Field of Search ..... 123/440, 489, 492, 493

[56] References Cited

U.S. PATENT DOCUMENTS

| | | | |
|---|---|---|---|
| 4,454,847 | 6/1984 | Isomura et al. | 123/492 |
| 4,467,769 | 8/1984 | Matsumura | 123/489 |
| 4,483,301 | 11/1984 | Yamada et al. | 123/489 |
| 4,494,512 | 1/1985 | Kishi et al. | 123/489 |
| 4,545,355 | 10/1985 | Takao et al. | 123/489 |

*Primary Examiner*—Willis R. Wolfe, Jr.

*Attorney, Agent, or Firm*—Pollock, VandeSande & Priddy

[57] ABSTRACT

A method for controlling air-fuel ratio of the mixture to be supplied to the engine detects whether or not the amount of the fuel to be supplied to the engine is greater than a reference amount. A feedback control in which the air-fuel ratio is corrected according to an oxygen concentration in the exhaust gas is performed when the amount of the fuel to be supplied to the engine is equal to or smaller than the reference level, while an open loop control in which the air-fuel ratio of the mixture is determined irrespective of the oxygen concentration is performed if the amount of the fuel to be supplied to the engine is greater than the reference level. The reference amount is changed depending on the engine rotational speed so as to eliminate the overlap of a range of the fuel increment control and a range of the feedback control and greatly improve the driveability of the engine during high load operating conditions of the engine.

2 Claims, 7 Drawing Figures

METHOD FOR CONTROLLING AIR/FUEL RATIO OF FUEL SUPPLY FOR AN INTERNAL COMBUSTION ENGINE

BACKGROUND OF THE INVENTION

1. Field of the Invention

The present invention generally relates to a method for controlling air/fuel ratio of fuel supply system for an internal combustion engine.

2. Description of Background Information

In order to supply proper amount of fuel to an internal combustion engine, fuel supply systems are generally in use in which the fuel is supplied to the engine in accordance with a fuel supply control signal and uses a fuel supply device such as a fuel injector or injectors. The fuel supply control signal is calculated from a basic value of the fuel supply which is repeatedly derived using a basic engine parameter, such as a pressure in the intake passage of the engine, in synchronism with the engine rotation. To derive an actual fuel supply amount, an increment compensation or a decrement compensation is effected to the basic value in response to auxiliary engine parameters, such as an engine coolant temperature, or a parameter indicative of transitional changes of the engine. The fuel injector is actuated for each time duration corresponding to the thus derived actual fuel supply amount.

In the case of this type of fuel supply control system, if a three-way catalytic converter is provided in an exhaust system of the engine for the purification of the exhaust gas, the air-fuel ratio of the mixture to be supplied to the engine is to be controlled around a stoichiometric value (14.7:1, for instance) because the operation of the three-way catalytic converter is optimized when the air-fuel ratio of the mixture is controlled at the stoichiometric value.

For satisfying this requirement, an arrangement is generally utilized in which oxygen concentration in the exhaust gas is detected as one of the engine parameters by means of an oxygen concentration sensor (abbreviated as $O_2$ sensor hereinafter) provided in the exhaust system. The basic value is corrected in accordance with an output signal of the $O_2$ sensor so as to effect a feedback control operation through which the air-fuel ratio of the mixture supplied to the engine is controlled at the stoichiometric value.

However, the feedback control of the air-fuel ratio is not always effected. During a predetermined operating condition of the engine such as in a state where the engine coolant temperature is low, or a high load operating condition of the engine, the air-fuel ratio is enriched by an open loop control where the air-fuel ratio is determined without regard to the output signal of the $O_2$ sensor.

In addition, the enrichment of the air-fuel ratio by increasing the fuel supply amount during the high load operation of the engine has an advantageous effect such that the engine is protected by the cooling effect of the enriched mixture during a high speed operation of the engine by which knocking and temperature rise of the cylinder wall are prevented. In order to sense a control range for the enrichment of the air-fuel ratio in terms of the engine rpm and the pressure within the intake pipe of the engine, a reference level is utilized in that a reference level of the vacuum is changed stepwisely with the variation of the engine speed. Specifically, the reference level of the pressure decreases as the engine speed increases.

On the other hand, a control method to be effected in a fuel supply system having this type of air-fuel ratio control operation is disclosed in Japanese Patent provisional publication No. 59-548. In this method, when the fuel supply amount exceeds a predetermined value, it is detected that the engine is operating under a high load condition and the open loop control is selected instead of the feedback control of the air-fuel ratio.

However, when the control range for increasing the fuel supply amount during the high load operating condition is detected in terms of the engine rotational speed and the pressure in the intake passage and the reference level of the pressure varies depending on the engine rotational speed as already described, there was a problem of the generation of an undesirable control range where necessary enrichment of the air-fuel ratio does not occur since the feedback control is selected because the derived fuel supply amount is smaller than the predetermined value. In such undesirable control range, the drivablity of the engine will be deteriorated.

SUMMARY OF THE INVENTION

An object of the present invention is therefore to provide a method for controlling air-fuel ratio of the mixture to be supplied to the engine in which an overlap between a range of fuel increment control during a high load operating condition of the engine and a range of feedback control is eliminated so as to greatly improve the driveability of the engine.

According to the present invention, a method for controlling air-fuel ratio of the mixture to be supplied to the engine includes a step for detecting whether or not an amount of fuel to be supplied to the engine is greater than a reference amount, a step for correcting an air-fuel ratio of the mixture to be supplied to the engine in response to an oxygen concentration in an exhaust gas of the engine so as to perform a feedback control when the amount of fuel to be supplied to the engine is equal to or smaller than the reference amount, and a step for correcting the air-fuel ratio of the mixture irrespective of the oxygen concentration when the amount of fuel to be supplied to the engine is greater than the reference amount; the method is characterized in that the reference amount is changed according to a rotational speed of the engine.

Further scope and applicability of the present invention will become apparent from the detailed description given hereinafter. However, it should be understood that the detailed description and a specific example, while indicating a preferred embodiment of the invention, are given by way of illustration only, since various changes and modifications within the spirit and scope of the invention will become apparent to those skilled in the art from this detailed description.

DETAILED DESCRIPTION OF A PREFERRED EMBODIMENT

Figure 1:
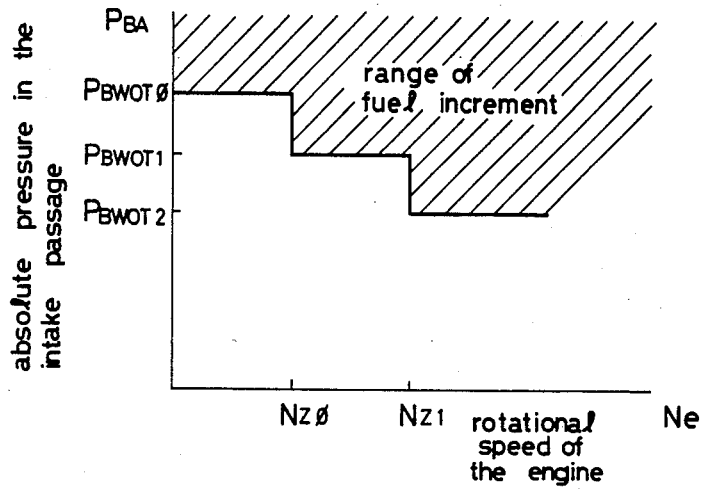
FIG. 1 is a graph showing the characteristic of setting of a reference value of absolute pressure in the intake passage relative to the rotational speed of the engine, for determining a range of fuel increment, used as a basic technique of the present invention.

Reference is first made to FIG. 1 in which the manner of variation of a reference value of absolute pressure in the intake passage relative to the rotational speed of the engine, for determining a range of fuel increment is illustrated.

As shown, the fuel increment is affected when the absolute pressure in the intake passage is higher than the reference value. The reference value is set so that it reduces stepwisely as the rotational speed of the engine increases. Therefore, if the high load condition is detected by simply comparing the fuel supply amount with a reference fuel supply amount, there can be a region in which the necessary fuel increment is not performed since the feedback control is performed because the derived fuel supply amount is smaller than the reference fuel supply amount.

An embodiment of the air-fuel ratio control method of the present invention will be explained with reference to FIGS. 2 through 7 of the accompanying drawings.

Figure 2:
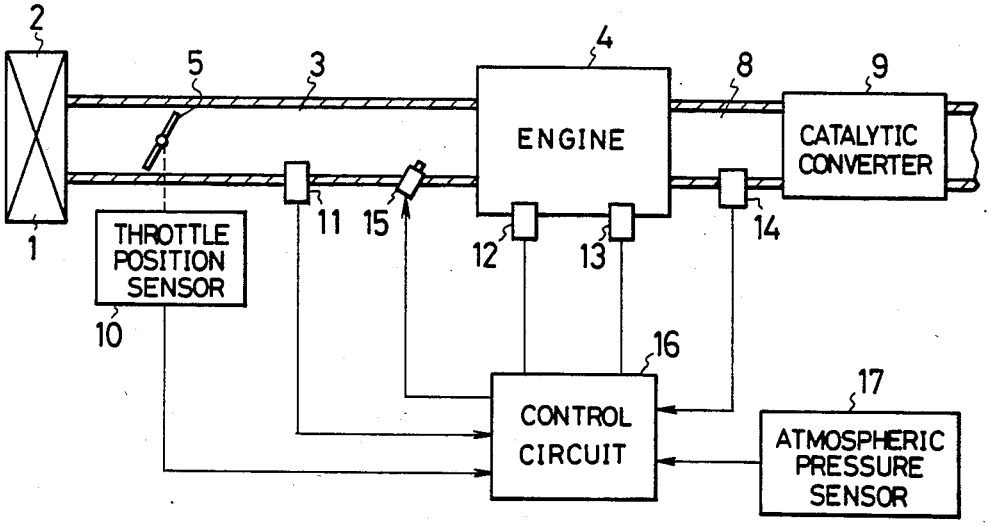
FIG. 2 is a schematic diagram showing an electronically controlled fuel injection system in which the air-fuel ratio control method of the present invention is applied.

In FIG. 2, intake air taken at an air inlet port is supplied to an internal combustion engine 4 through an air cleaner 2, and an intake air passage 3. A throttle valve 5 is disposed in the intake air passage so that the amount of the air taken into the engine is controlled by an opening angle thereof. In an exhaust passage 8 of the engine 4, a three-way catalytic converter 9 is provided so as to accelerate the reduction of the noxious components (CO, HC, and NOx) in the exhaust gas.

The reference numeral 10 indicates a throttle position sensor 10 made up of a potentiometer for example and producing an output voltage whose level is responsive to the opening angle of the throttle valve 5. Also, an absolute pressure sensor 11 is provided on the downstream side of the throttle valve 5 so as to produce a voltage level corresponding to the magnitude of the absolute pressure in the intake air passage, downstream of the throttle valve. An engine coolant temperature sensor 12 is provided so as to produce a voltage level proportional to the temperature of the engine coolant. A crank angle sensor 13 is provided which produces pulse signals in accordance with the rotation of the crankshaft of the engine such that a pulse signal is produced for every 120° rotations of the crankshaft, for example. In the exhaust passage 8, an oxygen concentration sensor 14 is provided, on the upstream side of the three-way catalytic converter 9, so that a voltage representing the oxygen concentration in the exhaust gas is produced. The reference numeral 15 indicates an injector provided in the intake air passage 3 of the engine 4, near an inlet valve (not shown).

Output terminals of the throttle position sensor 10, absolute pressure sensor 11, engine coolant temperature sensor 12, crank angle sensor 13, and oxygen concentration sensor 14, and an input terminal of the injector 15 are connected to a control circuit 16. An atmospheric pressure sensor 17 is also connected to the control circuit 16.

Figure 3:
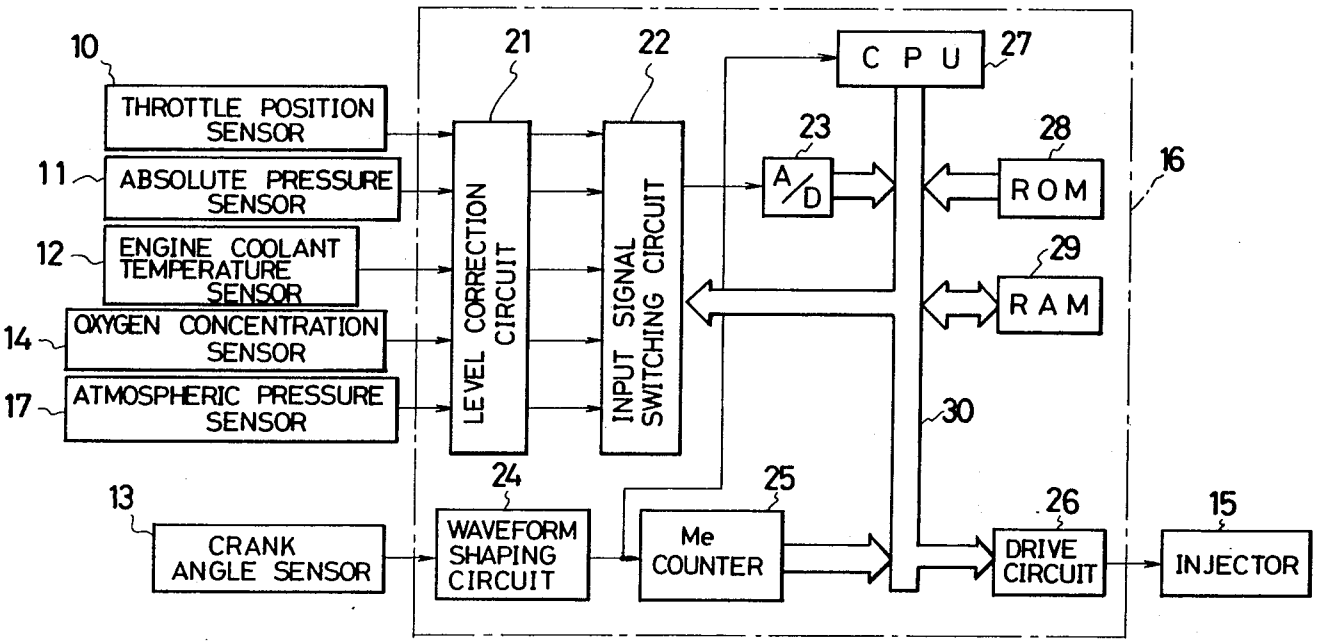
FIG. 3 is a block diagram showing the concrete construction of the control circuit utilized in the system of FIG. 2.

As shown in FIG. 3, the control circuit 16 is made up of a level correction circuit 21 for correcting the level of output signals of the throttle position sensor 10, absolute pressure sensor 11, the engine coolant temperature sensor 12, oxygen concentration sensor 14, and the atmospheric pressure sensor 17. Output signals of the level correction circuit 21 are supplied to an input signal switching circuit 22 for selectively transmitting one of the output signals of the level correction circuit 21. An output signal of the level correction circuit 21 which is produced in analog form is then supplied to an A/D (analog to digital) converter 23 where the input analog signal is converted into a digital signal. The control circuit 16 further includes a waveform shaping circuit 24 for an output signal of the crank angle sensor 13, a counter 25 for counting the time interval between each pulse of TDC (top dead center) signal supplied from the waveform shaping circuit 24, a drive circuit of the injector 15, a CPU (central processing unit) 27 for performing digital arithmetic operations according to predetermined programs, a ROM 28 in which various programs are stored, and a RAM 29. The input signal switching circuit 22, the A/D converter 23, the counter 25, the drive circuit 26, the CPU 27, the ROM 28 and the RAM 29 are mutually connected by means of an input/output bus 30. Also, the TDC signal produced at the waveform shaping circuit 24 is supplied to the CPU 27.

With this circuit construction, information indicative of the throttle valve opening degree, absolute value in the pressure passage, engine coolant temperature, atmospheric pressure, and oxygen concentration in the exhaust gas is selectively supplied from the A/D converter 23 to the CPU 27, and a count value information indicative of an inverted value of the engine rpm is supplied from the counter 25 to the CPU 27, both via the input/output bus 30. In the ROM 28, computing programs and various data for the arithmetic operation in the CPU 27 are stored previously.

The CPU 27 reads-in the above-mentioned various information in accordance with the program stored in the ROM 28 and calculates the fuel injection time $T_{OUT}$ of the injector 15 corresponding to the amount of the fuel supplied to the engine 4 using a calculation formula described later, in response to these information and in synchronism with the TDC signal. The fuel injector 15 is actuated by the drive circuit 26 only for the fuel injection time $T_{OUT}$ so as to supply the fuel to the engine 4.

The fuel injection time $T_{OUT}$ is, for instance, calculated by the following formula:

$$T_{OUT} = T_i \times K_{O2} \times K_{WOT} \times K_{TW}$$

where $T_i$ represents a basic supply amount determined by the engine rotational speed and the pressure in the intake passage, $K_{O2}$ represents a feedback correction coefficient of the air-fuel ratio, $K_{WOT}$ represents a fuel increment correction coefficient for a high load operation, $K_{TW}$ represents a coefficient of the engine coolant temperature. The correction coefficients of $K_{O2}$, $K_{WOT}$, and $K_{TW}$ are calculated or set in subroutines of a main routine of the calculation of fuel injection time $T_{OUT}$.

Figure 4:
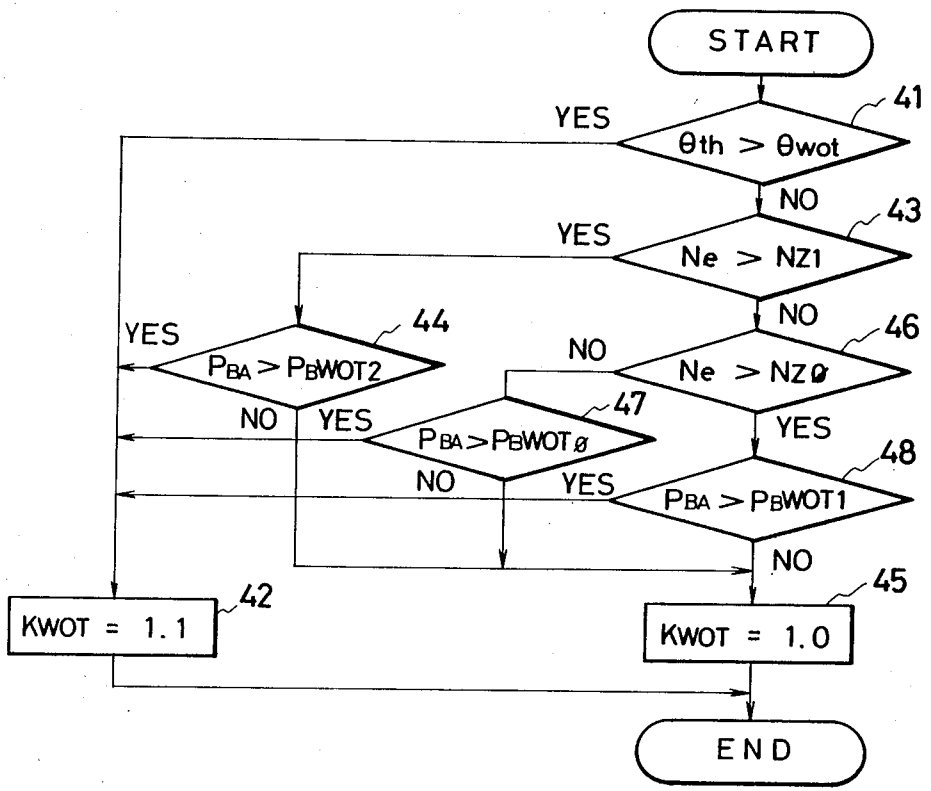
FIG. 4 is a flow chart showing steps for determining a fuel increment correction coefficient.

For instance, the fuel increment correction coefficient $K_{WOT}$ is set by the control circuit 16 in the steps shown in the flowchart of FIG. 4.

In FIG. 4, the control circuit 16 detects whether or not the opening angle $\theta_{th}$ of the throttle valve 5 is greater than a predetermined opening angle $\theta_{WOT}$ of nearly fully open state, at a step 41. If $\theta_{th}>\theta_{WOT}$, the fuel increment correction coefficient $K_{WOT}$ is set at 1.1 at a step 42 so that the air-fuel ratio is enriched by the fuel increment. If $\theta_{th}\leqq\theta_{WOT}$, whether or not the engine rotational speed $N_e$ is greater than the predetermined speed level $N_{z1}$ shown in FIG. 1 is detected at a step 43. If $N_e>N_{z1}$, whether or not the absolute pressure in the intake passage $P_{BA}$ is greater than a predetermined pressure level $P_{BWOT2}$ is detected at a step 44. If $P_{BA}>P_{BWOT2}$, the program goes to the step 42, and on the other hand, if $P_{BA}\leqq P_{BWOT2}$, the fuel increment correction coefficient is set at 1 at a step 45 as it judges to be out of the fuel increment control range. If, on the other hand, $N_e\leqq N_{z1}$ at the step 43, whether or not the rotational speed of the engine $N_e$ is greater than a predetermined speed level $N_{z0}$ which is smaller than $N_{z1}$ is detected at a step 46. If $N_e>N_{z0}$, whether or not the absolute pressure in the intake passage $P_{BA}$ is greater than a predetermined level $P_{BWOT1}$ which is greater than $P_{BWOT2}$ is detected at a step 48. If $P_{BA}>P_{BWOT1}$, the program goes to the step 42, and on the other hand, if $P_{BA}\leqq P_{BWOT1}$ the program goes to the step 45. If $N_e\leqq N_{z0}$ at the step 46, whether or not the absolute pressure in the intake passage $P_{BA}$ is greater than a predetermined level $P_{BWOT0}$ which is greater than the predetermined level $P_{BWOT1}$ is detected at a step 47. If $P_{BA}>P_{BWOT0}$, the program goes to the step 42, and on the other hand, if $P_{BA}\leqq P_{BWOT0}$, the program goes to the step 45.

The air-fuel ratio control operation of the control circuit 16 will be explained hereinafter with reference to the operation flowchart of FIG. 5.

Figure 5:
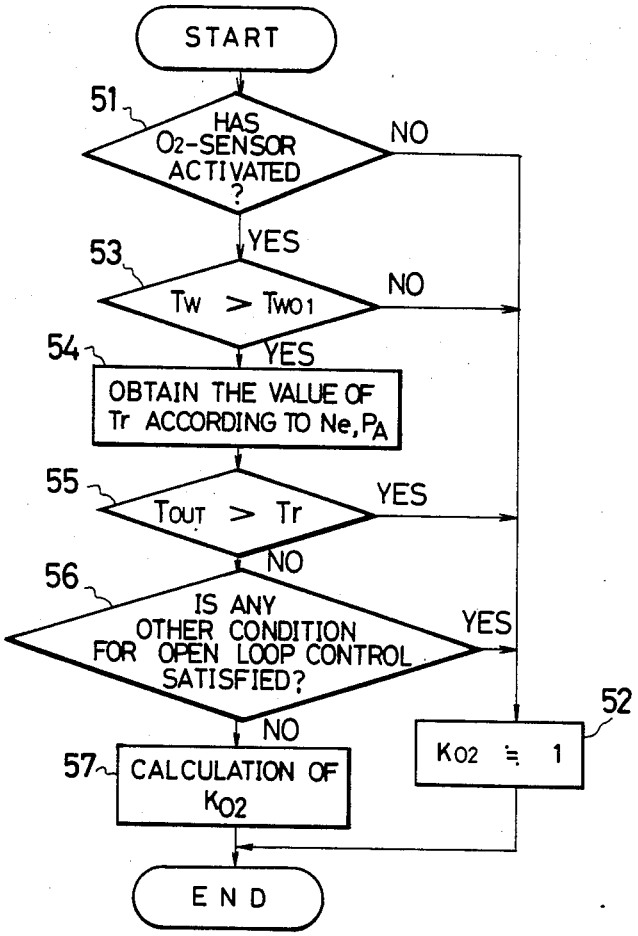
FIG. 5 is a flow chart showing the operation of the control circuit as an embodiment of the present invention.
Figure 6:
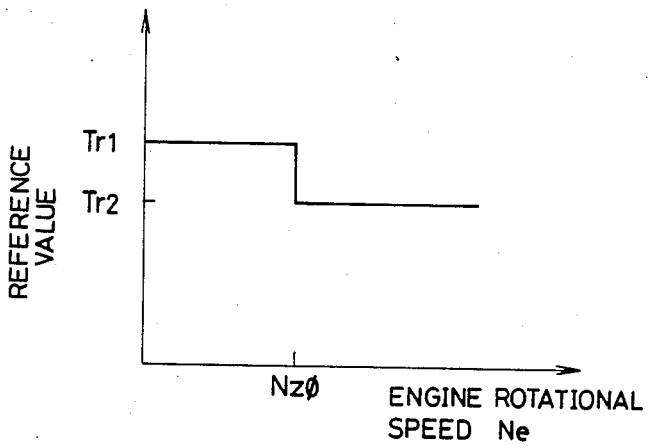
FIG. 6 is a diagram showing the characteristic of setting of a reference level of the fuel injection time with respect to the rotational speed of the engine.

In the sequential operations of FIG. 5, the control circuit 16 detects whether or not the activation of the oxygen sensor 14 has been completed at a step 51 in synchronism with an n-th (latest) TDC signal. Since the voltage level of the output signal $V_{O2}$ of the oxygen sensor 14 varies, in a lean atmosphere, such that it goes up to a predetermined voltage level $V_x$ and subsequently it falls below the predetermined level, the detection of the activation of the oxygen sensor 14 occurs when a predetermined time period $t_x$ has passed after the level of the output signal $V_{O2}$ of the oxygen sensor 14 has become lower than the predetermined level $V_x$.

When it is detected that the activation of the oxygen sensor is not completed, the feedback coefficient $K_{O2}$ is set almost at 1 at a step 52 so that the air-fuel ratio control is performed by an open loop operation. On the other hand, if the oxygen sensor 14 is activated, step 53 determines, whether or not the engine coolant temperature $T_w$ is greater than a temperature level $T_{WO1}$ for starting the feedback control. If $T_w<T_{WO1}$, the program goes to the step 52 so that the open loop control is performed. On the other hand, if $T_w>T_{WO1}$, a reference value $T_r$ determined according to the rotational speed of the engine $N_e$ and the atmospheric pressure $P_A$ is looked up, at a step 54, from a data map which is previously stored in the ROM 28. The reference value $T_r$ is set at one of first and second reference values $T_{r1}$ and $T_{r2}$, in accordance with a threshold level set at the predetermined rotational speed $N_{z0}$. Specifically, in a basic mode in which $N_e<N_{z0}$, the first predetermined value $T_{r1}$ is picked up from the data map and used as the reference level $T_r$. On the other hand, in a medium speed mode in which $N_e>N_{z0}$, the second predetermined value $T_{r2}$ is picked up from the data map and used as the reference value $T_r$.

Figure 7:
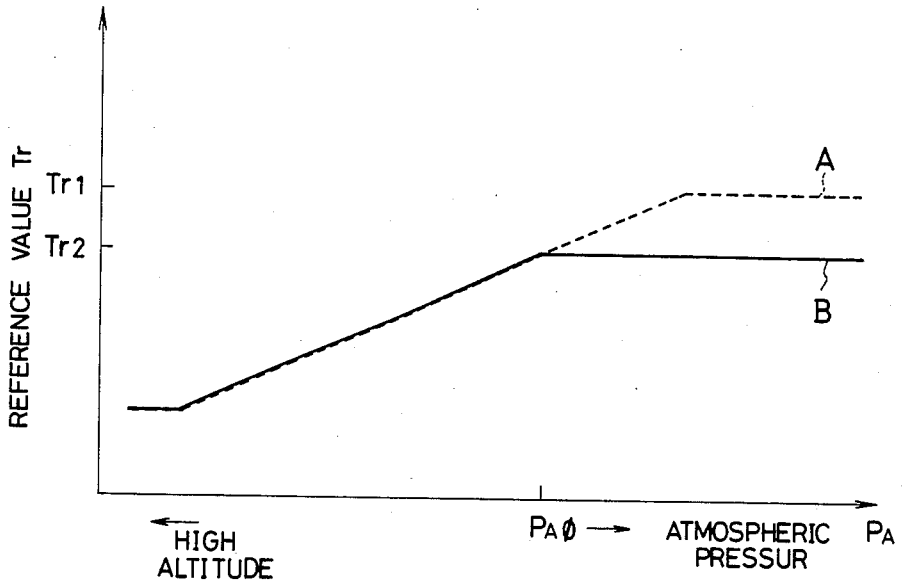
FIG. 7 is a diagram showing the characteristic of setting of a reference level of the fuel injection time with respect to the atmospheric pressure.

On the other hand, the reference level $T_r$ is determined with respect to the atmospheric pressure $P_A$ in such a manner as shown in FIG. 7. When the atmospheric pressure $P_A$ drops below a predetermined level $P_{A0}$, predetermined values for both the basic mode (indicated by the dashed line A) and the medium speed mode (indicated by the solid line B), below the second predetermined value $T_{r2}$ are picked up from the data map and used as the reference value $T_r$. After establishing the reference value $T_r$ in the above described manner, the control circuit 16 detects whether or not a fuel injection time $T_{OUT}$ which is calculated in synchronism with an n-1 th (previous) TDC signal is greater than the reference level $T_r$, at a step 55. If $T_{OUT}>T_r$, the program goes to the step 52 so that the open loop control is performed, as it is judged that the engine is operating under a high load condition. If $T_{OUT}\leqq T_r$, whether or not another operating condition of the engine which requires the open loop control is satisfied is detected at a step 56. If the detected result indicates that the engine is operating under a state where the open loop control is required, such as in the fuel-cut operation or in the idling of the engine, the program goes to the step 52. On the other hand, if the result of the detection indicates that the condition of the operation of the engine for the open loop control is not satisfied, the feedback coefficient $K_{O2}$ is calculated at a step 57 for the feedback control.

Thus, according to the air-fuel ratio control method of the present invention, when the engine rotational speed is lower than a predetermined level $N_{z0}$, the fuel injection time $T_{OUT}$ is compared with a first predetermined value $T_{r1}$ (whether or not $T_{OUT}>T_{r1}$ is detected) at a step 55 and the feedback control of the air-fuel ratio is stopped to perform the open loop control if $T_{OUT}>T_{r1}$. On the other hand, if the engine rotational speed is higher than the predetermined level $N_{z0}$, the fuel injection time $T_{OUT}$ is compared with a second predetermined value $T_{r2}$ (whether or not $T_{OUT}>T_{r2}$ is detected) at the step 55 and the feedback control of the air-fuel ratio is stopped to perform the open loop control if $T_{OUT}>T_{r2}$.

The feedback control of the air-fuel ratio is performed such that the actual air-fuel ratio of the mixture supplied to the engine is estimated by means of information such that the oxygen concentration in the exhaust gas, and the feedback coefficient $K_{O2}$ is determined so that the air-fuel ratio is controlled to the lean side when the detected air-fuel ratio is rich, and to the rich side when the detected air-fuel ratio is lean. In this way during the feedback air-fuel ratio control, the air-fuel ratio is always controlled at the stoichiometric value.

It will be appreciated from the foregoing, according to the air-fuel ratio control method of the invention, the range of the feedback control of the air-fuel ratio can be determined in consideration of the range of the fuel increment during the high load operation of the engine. Specifically, the feedback control is stopped and open loop control is performed when the amount of the fuel to be supplied to the engine is greater than the reference level, and the reference level is changed according to the rotational speed of the engine.

Thus, the overlap between the range of the fuel increment and the range of the feedback control is eliminated so that the driveability of the engine during the high load condition is greatly improved.

What is claimed is:

1. A method for controlling an air-fuel ratio of mixture to be supplied to an internal combustion engine having a fuel supply system, comprising the steps of:

detecting whether or not an amount of the fuel to be supplied to the engine by means of said fuel supply system is greater than a reference amount;

correcting the air-fuel ratio of the mixture to be supplied to the engine in response to an oxygen concentration in an exhaust gas so as to perform a feedback control when the amount of the fuel to be supplied to the engine is equal to or smaller than the reference amount;

correcting the air-fuel ratio of the mixture to be supplied to the engine irrespective of said oxygen concentration so as to perform an open loop control when the amount of the fuel to be supplied to the engine is greater than the reference amount;

detecting a rotation speed of the engine; and, reducing a level of said reference amount as rotational speed of the engine increases.

2. A method as set forth in claim 1, wherein said fuel supply system is a fuel injection system, and wherein whether or not a fuel injection time corresponding to said fuel supply amount is greater than a reference value corresponding to said reference amount is detected in said step of detecting.

* * * * *